US005087486A

United States Patent [19]

DeVos et al.

[11] Patent Number: 5,087,486

[45] Date of Patent: Feb. 11, 1992

[54] METHOD AND APPARATUS FOR BLASTING PARTS

[75] Inventors: David J. DeVos; Bruce A. Sterenberg, both of Caledonia; Michael L. Tubergen, Kentwood, all of Mich.

[73] Assignee: Progressive Blasting Systems, Inc., Grand Rapids, Mich.

[21] Appl. No.: 340,282

[22] Filed: Apr. 19, 1989

[51] Int. Cl.[5] ..... B05D 1/32; B05D 3/12; B05C 11/00; B05C 13/00

[52] U.S. Cl. ..... 427/264; 427/272; 427/275; 118/500; 118/505

[58] Field of Search ..... 51/310–312, 51/277; 427/272, 275, 264; 118/505, 500; 269/309, 310, 47, 52

[56] References Cited

U.S. PATENT DOCUMENTS 569,160 10/1896 Ball et al. ..... 118/500

*Primary Examiner*—Evan Lawrence
*Attorney, Agent, or Firm*—Price, Heneveld, Cooper, DeWitt & Litton

[57] ABSTRACT

A method and apparatus for masking a part during a multi-step process including a blasting process using abrasive media for etching or cleaning a part. In each step of the multi-step process, the workpiece and mask are aligned together by pins extending from a supporting surface of the apparatus. The pins have a lower surface configured to hold the workpiece and an upper part or portion of a triangular cross section to provide line contact with the walls of apertures in the mask and part. The triangular configuration keeps the mask aligned with the workpiece while at the same time allowing air to pass through the apertures. After the abrasive blasting process, a stream of compressed air is applied to the bottom of the part and mask to cause the mask to move or flutter up and down relative to the surface of the part. The compressed air sweeps away the abrasive media and debris so that the part and mask can be moved on for further processing with no danger that the mask has been accidentally locked to the part by material collecting in the aperture between the mask and pin or that the part has been locked to the pin.

10 Claims, 3 Drawing Sheets

METHOD AND APPARATUS FOR BLASTING PARTS

BACKGROUND OF THE INVENTION

When a metal part requires that only a portion of its surface undergo several processing steps such as blasting with abrasive media for surface preparation by etching or cleaning followed by applying a coating and a sealant for the coating, two procedures have customarily been followed. In the first procedure, the entire part was blasted and then had to be handled to put a mask in place for subsequent processing. During the process of applying the mask, the clean part was subjected to contamination and possible scratching. In the second procedure, if conventional pins were used to hold the part during the blasting process, the mask could be put in place and held in position by the pins. While this appeared to solve the problems associated with handling the cleaned part instead, it created more serious problems. During the blasting process, blasting media and debris often collected under the mask and particularly in the apertures between the supporting pins and the mask. The part would be sent through the remaining procedural steps only to find out at the end that the mask could not be removed without seriously damaging either the mask or the part. During the process, abrasive media and debris accumulated in the space between the pin and the mask and firmly fixed the two together. Also, the abrasive media and debris which collected between the mask and workpiece presented a potential contamination problem in subsequent processing steps.

SUMMARY OF THE INVENTION

The present invention is a method and apparatus for masking a part during a multistep process including a blasting process. In the method of the invention a part to be cleaned or etched and coated is mounted on the apparatus of the invention by mounting on pins on a suitable support. A mask is then be placed over the same pins into contact with the face of the part. The lower portion of the pins are shaped to locate or laterally position the workpiece and have a shoulder leading to a triangular shaped pin portion. The triangular pins fit within and have line contact with the wall of the apertures in the mask and aperture or cutaway areas in part. A mask holder is then positioned above the mask but not in contact with the mask. The holder is placed over a portion of the part and mask not requiring surface preparation and other processing.

In operation, the portion of the part to be cleaned or etched is exposed through the mask and is subjected to high pressure blasting with a suitable blasting media such as sand or aluminum oxide. The blasting process is essentially line of sight with the blasting media directly striking the part through the open area in the mask. After the blasting process, compressed air is blown onto the underside of the part. The air causes the mask to lift and flutter on the surface of the part. The aforementioned holder keeps the mask from being blown off the part.

The stream of compressed air keeps the mask moving and sweeps the blasting material and debris off the surface of the part and out of the holes in the mask through which the triangular mask supporting pins pass. At the end of the compressed air blowing process, the exposed portion of the part has been cleaned or etched and all loose material has been cleaned away from the part and mask. The part with the mask still in place can now proceed through the remaining processing steps without danger that the mask cannot be safely removed or that potential contaminants are present. The mask is put on the part before any processing begins and is removed when all of the processing is completed with no need to handle the part or mask during the processing.

DETAILED DESCRIPTION OF THE PREFERRED EMBODIMENT

Figure 1:
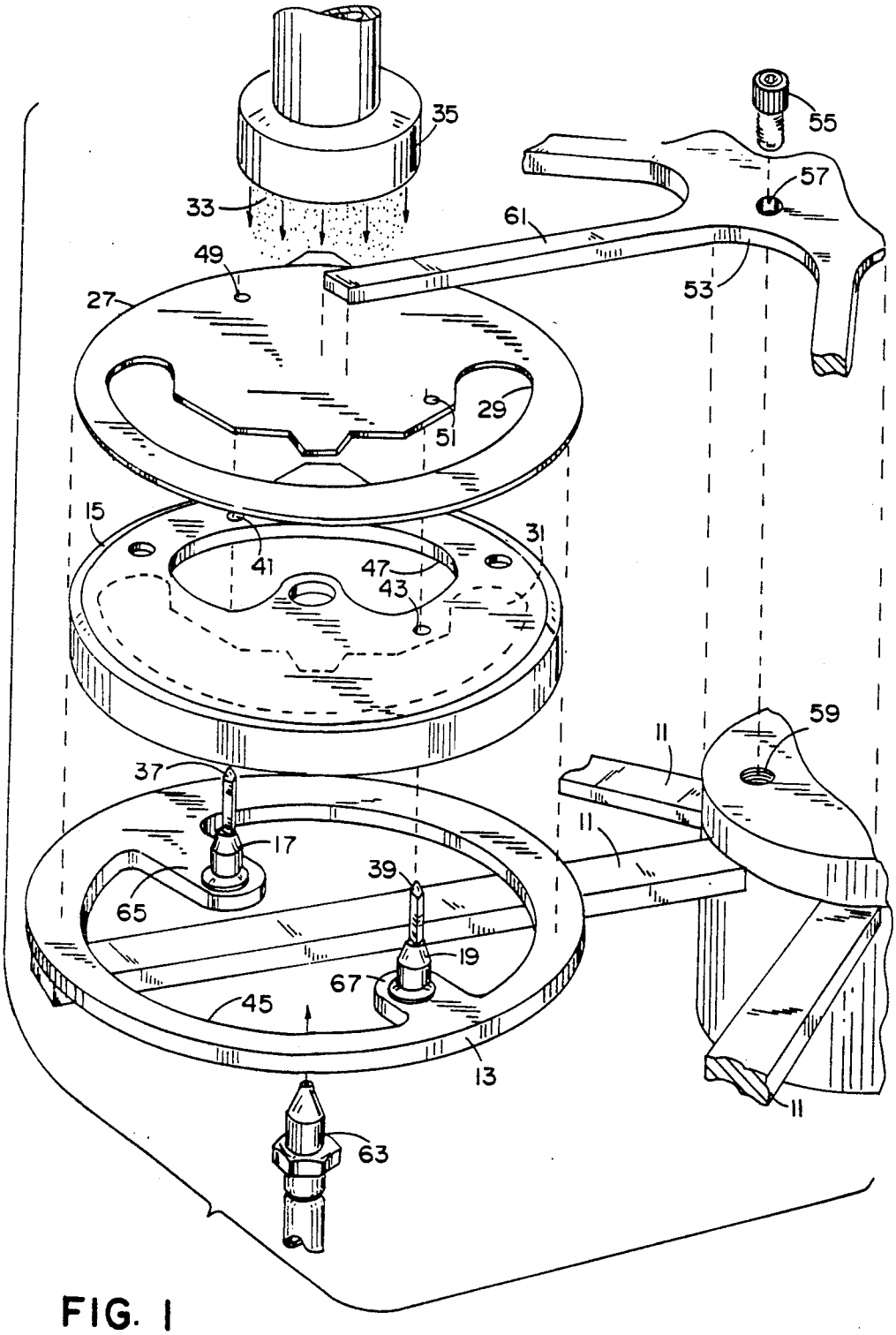
FIG. 1 is an exploded, partial perspective view of the blasting apparatus of the present invention.
Figure 2:
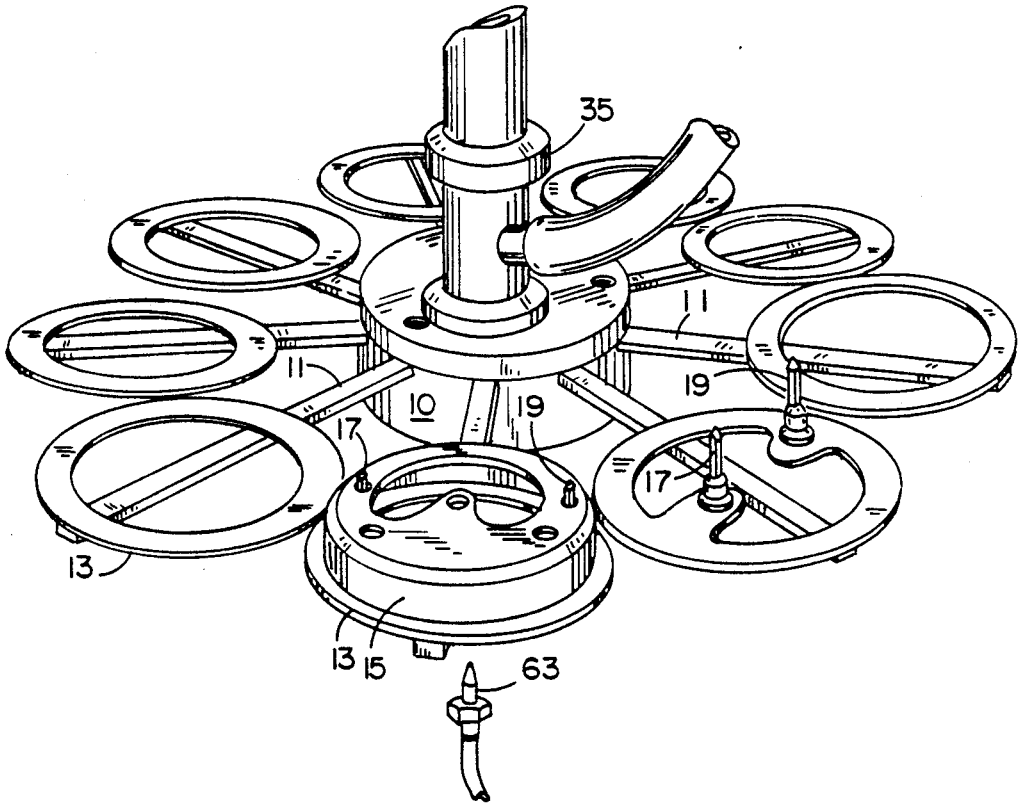
FIG. 2 is a perspective view showing a workpiece in position on a support in the blasting apparatus.

Referring to FIG. 1, a portion of a central hub 10 is shown having radially spaced projecting arms 11 about the periphery of the hub. Supported on each of the arms is a workpiece holder or support 13. This support or fixture 13 is preferably made of steel and is bolted to the arm 11. If the blasting machine is to only handle one type of part, the fixture 13 can be permanently fastened to the arm 11 by welding. In the preferred embodiment, the fixture 13 is of the same overall configuration as the workpiece 15 which it is to support.

Figure 5:
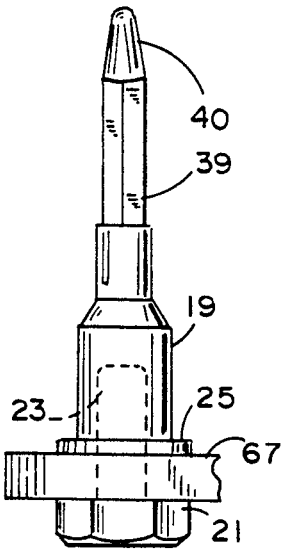
FIG. 5 is an elevational view of the workpiece and mask-holding pin of the present invention.

A pair of elongated pins 17 and 19 are shown mounted on the fixture 13. As shown in FIG. 5, the pin is fastened to the fixture 13 using a nut 21 which threads onto threaded portion 23 on the bottom of the pin. Alternatively, the pin can be fastened to the fixture 13 using a bolt threaded into a blind aperture in the bottom of the pin. In order to take advantage of existing apertures or cutout portions of the workpiece, holding pins can be sized to provide optimum line contact. It is possible then on a single fixture 13 to have more than one size pin. A washer 25 is used in fastening the pin to the support. The washer 25 can be of metal or rubber or other polymeric material. In the preferred embodiment, the washer 25 is made of rubber which provides a degree of flexibility in the mounting of the pin to the fixture 13. The flexible mounting of the pins enables a workpiece to move the pins as it is positioned on the fixtures 13, the objective is to locate the mask precisely to the workpiece, and the workpiece as needed with respect to the fixture. While it is possible to use rigid pins, such pins often tend to cause the mask to become jammed so that it can not flutter during the blowing process.

Again referring again to FIG. 1, a mask 27 is shown above the workpiece 15. The mask 27 is made of metal or other suitable nonmetallic material. The mask has an aperture 29 therein for exposing a portion of the surface 31 of the workpiece 15 to the stream of abrasive media 33 emanating from the high pressure blasting nozzle 35. The abrasive media used in the blasting process can be sand or preferably aluminum oxide.

In assembling the apparatus of the present invention for the high pressure blasting and low pressure blowing operations, the work piece 15 is placed onto the fixture 13 by passing the tapered portions 37 and 39 of the pins 17 and 19, respectively, through the apertures 41 and 43 in the workpiece 15. The workpiece 15 sits on the support 13 and is held in place by the pins 17 and 19 and the line contact provided to apertures 41 and 43 by the portion of pins 37 and 39. In the preferred embodiment, the pins are of one piece construction. It is within the scope of the invention to have the pins made of several pieces which are suitably fastened together by welding, brazing or even a threaded shaft passing internally through the several pieces. In the preferred embodiment, support 13 has the same outer dimensions as that of the workpiece 15. The support 13 has an aperture 45 therein so that a fluid medium such as compressed air or nitrogen or any other desired gas can be blown upwardly through the fixture into contact with the inner surface of the workpiece 15. The workpiece 15 also has an aperture 47 which is covered by the mask 27.

The workpiece 15 is put in position on a fixture 13 where it is located by the pins 17 and 19. A mask 27 is then placed on top of the workpiece by passing the mask over portions 37 and 39 of pins 17 and 19. The pins should be slightly smaller than the aperture in the mask to allow the mask to move while maintaining accurate positioning with respect to the workpiece. The shaped portions of the pins provide line contact with the walls of apertures 49 and 51 in the mask 27. After the mask 27 is in position, a mask holder 53 is put in position on the top of the hub 10. The mask holder is held in place by pins 55 in the top surface of the hub 10 which pass through apertures 57 in the holder. In the preferred embodiment, the weight of the holder keeps it in position during the blasting and blowing processes while allowing for quick removal of workpieces and masks. It is also within the scope of the present invention to have the mask holder come down in the blast chamber by means of a positioning actuator. In the preferred embodiment, the upper portion 40 of each pin is tapered as shown in FIG. 5, to help align or center the mask 27 with the pin during the blowing process. The tapered portion tends to ensure that the mask will fall back onto the workpiece without becoming coked or jammed on the pins. The extended portion 61 of the mask holder 53 projects out over the mask 27 when it is in place on the workpiece 15 but does not contact the mask 27 to put pressure on it. The mask holder 53 is meant to be a keeper to hold the mask 27 in position on the workpiece 15 and to allow the mask 27 to rise and fall or flutter on the shaped portions 37, 39, and 40 of the pins 17 and 19, respectively.

Figure 3:
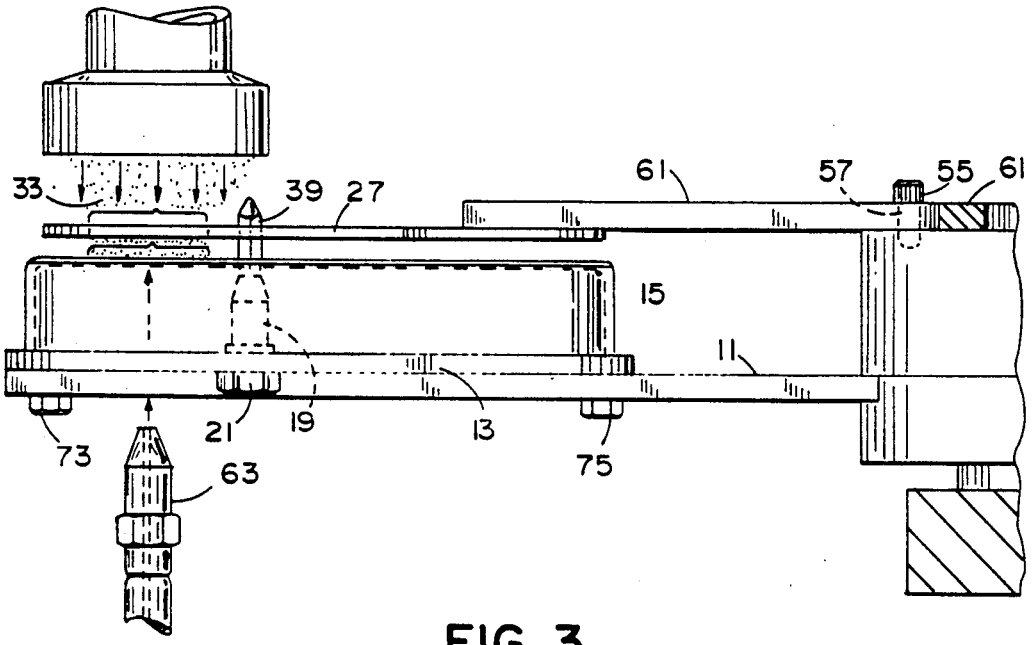
FIG. 3 is a partial elevational view showing a part being blasted and also showing the mask supported away from the part.
Figure 4:
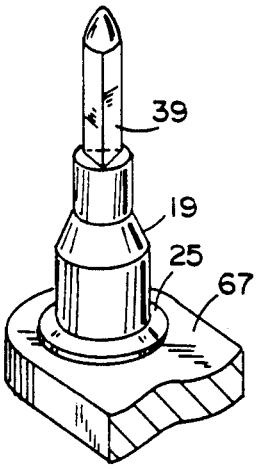
FIG. 4 is a perspective view of the workpiece and mask holding pin of the present invention.

After the blasting process, referring to FIG. 3, a stream of air is directed upwardly from the nozzle 63 and passes through the aperture 45 in the fixture 13 and the apertures 41, 43 and 47 in the workpiece 15 to strike the lower surface of the mask 27. The stream of air causes the mask 27 to rise and fall or flutter and move relative to the surface of the workpiece 15. The pin shown in FIG. 3 is pin 19, the mask 27 moves and has line contact with the shaped portion 39 of the pin. The upper portion of the workpiece 15 also has line contact with the tapered portion 39 of pin 19 to ensure removal of blasting media and debris.

In the preferred embodiment, the shaped portion 39 is of a triangular cross section providing three lines of contact with the wall of the aperture in the mask 27. Within broader aspects of this invention, other configurations of pins can be used such as square, X or Y shaped. It is only important that the configuration provide line contact with the mask and only allow the mask to move up and down thereby maintaining its position relative to the portion 31 of the workpiece 15 which is to be cleaned or etched by blasting. The mask is limited by the pins from moving in the horizontal plane relative to the surface of the workpiece.

Figure 6:
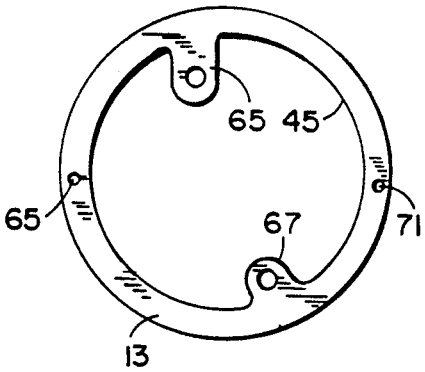
FIG. 6 is a top plan view of the workpiece holder used in the blasting device of the present invention.

As shown in FIGS. 1 and 6, the pins 17 and 19 are mounted on projecting portions 65 and 67 of the fixture 13. The projections are formed by cutting away excess metal in the fixture 13 to allow the maximum amount of air circulation in the cavity bounded by the fixture 13, workpiece 15, and mask 27. During the blasting process, the pressure of the air emanating from the nozzle 63 should preferably only be sufficient to cause the mask 27 to sustain unstable flight above the workpiece 15. The amount of air pressure needed is a function of the size of the cavity in the workpiece and the size and shape of the mask and of the aperture or cutout portion of the mask. A pressure of 50 to 60 psi has been found sufficient for most blowing applications. The pressure can be raised or lowered to obtain the optimum mask movement during the blasting process. With sufficient air pressure, the process becomes self-cleaning with the mask moving up and down on the shaped pins sweeping out all abrasive media and debris from the apertures in the mask and workpiece and since the mask in effect caps the aperture 47 in the workpiece 15, the air is directed across the surface of the workpiece 15 cleaning that surface.

FIG. 6 clearly shows the fixture 13 having the center area or aperture 45 substantially enlarged by cutting away excess material leaving the projections 65 and 67 for supporting the pins 17 and 19. Apertures 69 and 71 are provided in the fixture 13 for threadably receiving bolts 73 and 75, FIG. 3, for holding the fixture in place on the arm 11. The large aperture 45 enables a large volume of air to circulate within the cavity bounded by the workpiece 15 and the mask 71 to provide maximum opportunity for excess abrasive media and debris to be blown away during the blowing process.

With the blasting and blowing combination process being self-cleaning, the workpiece and mask can be moved from the blasting chamber to subsequent processing steps using the same mask. It is also within the scope of the present invention for the blasting to take place at one position in the blasting chamber with the blowing operation taking place at a second location in the same chamber. The workpiece and mask can then be moved from a first position where the workpiece is being cleaned or etched to a second position where the workpiece is being coated with a material using the same mask to shield off part of the surface of the workpiece. The workpiece, for example, could be given a plasma coating of aluminum oxide using the mask 27 to protect the unexposed surface of the workpiece and then the mask and workpiece could be moved to another process location where the coating added is sealed to protect it from moisture or other hostile environmental conditions. All of these process steps can be carried out by mounting the workpiece on a linear or rotating type of conveyor which carries the workpiece through and from the blasting chamber to and through the other treatment chambers without fear of subsequent process contamination or fear that the mask and workpiece have become rigidly bound to the pins by a force fit caused by abrasive and debris buildup in the apertures in the mask and workpiece.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. A method of treating a workpiece comprising:
a) mounting said workpiece on a supporting surface by means of at least two pins having a workpiece locating surface and a mask locating surface;
b) positioning a mask on said workpiece over said mask locating surface on said at least two pins;
c) preparing the surface of said workpiece exposed by said mask by blasting with an abrasive media;
d) applying air to a lower surface of said mask to cause said mask to move up and down on said pins relative to said workpiece to thereby remove the abrasive material and debris from said workpiece;
e) applying a coating to the surface of said workpiece exposed by said mask;
f) sealing the coating applied to the exposed surface by said mask; and
g) removing the mask from said workpiece.

2. A method of treating a workpiece as set forth in claim 1 wherein said mask locating surface on said pins provides line contact with said mask and holds said mask aligned with said workpiece.

3. A method of treating a workpiece comprising:
a) mounting said workpiece on a supporting surface by means of a plurality of spaced pins disposed on said surface, each of said pins having a workpiece locating surface and a mask locating surface;
b) positioning a mask on said workpiece by passing said mask over said mask locating surface of said workpiece supporting pins;
c) preparing the surface of said workpiece exposed by said mask by blasting said surface with an abrasive media;
d) applying air to a lower surface of said workpiece and said mask to cause said mask to move up and down on said pins while being constrained by said pins relative to the surface of said workpiece thereby enabling said blasting media and debris to be cleaned from the workpiece;
e) completing the further treating of said workpiece; and
f) removing said mask from said workpiece to expose the finished workpiece.

4. A method of treating a workpiece comprising the following steps;
a) providing at least two pins configured to hold a workpiece in a stable position on a supporting surface during each step of a multi-step process and also configured to allow limited movement of a mask on said pins relative to the surface of said workpiece under the influence of a stream of compressed air;
b) positioning a workpiece on said pins;
c) positioning a mask on said workpiece;
d) cleaning said workpiece by blasting with an abrasive, then applying air to the bottom surface of said mask to remove said abrasive and any debris from the surface of said workpiece;
e) completing the remaining processing steps of the multi-step process; and
f) removing the mask from said workpiece.

5. A workpiece and mask supporting tool having at least two pins, each of said pins mounted on a support comprising an elongated member having a surface with a triangular cross section configured to hold a workpiece in a stable position on the support and to hold a mask in an aligned position relative to the surface of said workpiece while allowing said mask to move up and down vertically relative to said workpiece under the influence of a fluid medium applied to the lower side of said workpiece and said mask.

6. A device for blasting a surface of a workpiece with a high power stream of abrasive media comprising:
a central hub;
at least one arm supported by said central hub;
at least one workpiece support having a substantially flat surface with at least one aperture therein disposed on said arm and adapted to be rotated in a horizontal plane about said hub;
at least two elongated pins disposed on said workpiece support having a surface configured to provide line contact with the wall of an aperture in a mask on said workpiece;
at least one mask configured so as to expose a portion of the surface of a workpiece when in position on said workpiece support;
a source of compressed air for directing a stream of air through the aperture in said workpiece support into contact with the workpiece and mask to cause said mask to move up and down relative to said workpiece during the blowing process to remove abrasive media and debris; and
a holder for said mask disposed on said hub and having at least one portion extending over and spaced from said mask to keep said mask from being blown off the workpiece by the compressed air.

7. A device for blasting a surface of a workpiece as set forth in claim 6 wherein said at least two elongated pins are flexibly mounted on said support.

8. A tool for supporting a workpiece and mask during an abrasive blasting and blowing process comprising:
a workpiece holder having a substantially flat surface with at least one aperture therein;
at least two elongated pins disposed on said holder configured to laterally position a workpiece on said support and to allow limited movement of said mask relative to said workpiece by providing line contact with the wall of an aperture in said mask, whereby a fluid medium can be blown through said aperture in said holder, during the blowing process, into contact with the workpiece and the mask to cause said mask to move up and down relative to said workpiece while in line contact with said pins to remove abrasive media and debris from said workpiece and said mask.

9. A tool as set forth in claim 8 wherein said holder is configured to match the outer configuration of a workpiece and said at least two pins are disposed on a portion of said support forming a projection into the aperture in said support.

10. A tool as set froth in claim 9 wherein at least one of said at least two pins is flexibly mounted on said holder.

* * * * *